US006239347B1

(12) United States Patent
Hatsumi

(10) Patent No.: US 6,239,347 B1
(45) Date of Patent: May 29, 2001

(54) MUSICAL SOUND EDITING APPARATUS AND RECORDING MEDIUMS ON WHICH A MUSICAL SOUND PROGRAM IS RECORDED

(75) Inventor: Yuichi Hatsumi, Hachioji (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 09/503,958

(22) Filed: Feb. 14, 2000

(30) Foreign Application Priority Data

Feb. 25, 1999 (JP) ..... 11-047647

(51) Int. Cl.[7] ..... G10M 7/00; G04B 13/00; A63H 5/00

(52) U.S. Cl. ..... 84/609; 84/610; 84/634; 84/649; 84/650

(58) Field of Search ..... 84/600–602, 604, 84/609–611, 615–616, 622–625, 634–635, 649–651, 653, 654, 659–660, 666–667

(56) References Cited

U.S. PATENT DOCUMENTS

| | | | | |
|---|---|---|---|---|
| 4,481,853 | | 11/1984 | Ishikawa . | |
| 4,594,931 | | 6/1986 | Ishii . | |
| 4,785,703 | * | 11/1988 | Ichiki | 84/634 |
| 5,576,506 | * | 11/1996 | Kawashima et al. | 84/602 |

* cited by examiner

*Primary Examiner*—Robert E. Nappi
*Assistant Examiner*—Marlon Fletcher
(74) *Attorney, Agent, or Firm*—Frishauf, Holtz, Goodman, Langer & Chick, P.C.

(57) ABSTRACT

A musical sound editing apparatus is provided having a general performance mode for performing a general performance of a musical sound, and a pattern create mode for creating a pattern of accompaniment data. When the mode is changed from the general performance mode to the pattern create mode, a tone of a musical sound produced is automatically changed from a tone in the general performance mode to a tone in the specified channel. When a new tone is specified in the pattern create mode, a tone allocated to a channel for a keyboard in a musical sound generator is changed to the new specified tone, and a tone allocated to the specified current channel is also changed to the new tone.

7 Claims, 20 Drawing Sheets

| | MF | TONE | KTONE | CURRENT | MEM(1) | MEM(2) | MEM(3) |
|---|---|---|---|---|---|---|---|
| FIG.20A | 0 | PIANO | | 1 | GUITAR | FLUTE | SAX |
| | TONE SELECT SWITCH "ORGAN" | | | | | | |
| FIG.20B | 0 | ORGAN | | 1 | GUITAR | FLUTE | SAX |
| FIG.20C | 1 | PIANO | PIANO | 1 | GUITAR | FLUTE | SAX |
| | TONE SELECT SWITCH "ORGAN" | | | | | | |
| FIG.20D | 1 | ORGAN | PIANO | 1 | ORGAN | FLUTE | SAX |
| | CHANNEL SELECT SWITCH "2" | | | | | | |
| FIG.20E | 1 | FLUTE | PIANO | 2 | ORGAN | FLUTE | SAX |
| | CHANNEL SELECT SWITCH "3" | | | | | | |
| FIG.20F | 1 | SAX | PIANO | 3 | ORGAN | FLUTE | SAX |

MUSICAL SOUND EDITING APPARATUS AND RECORDING MEDIUMS ON WHICH A MUSICAL SOUND PROGRAM IS RECORDED

TECHNICAL FIELD

The present invention relates to musical sound editing apparatus and recording mediums, on which a musical sound editing program is recorded.

BACKGROUND ART

There are musical sound editing apparatuses, for example, of conventional electronic keyboard instruments, having a general performance function as well as a pattern sequencer function. According to the latter function, accompaniment data, for example, forming a rhythm can be edited. In the general performance mode, a melody channel generates a melody part in accordance with keyboard performance and a plurality of accompaniment channels also generates musical sounds of accompaniment parts such as a rhythm, a base and a chord. In a pattern create mode which creates accompaniment data, one accompaniment part is specified and its accompaniment data is created.

When, for example, the mode is changed from the general performance mode to the pattern create mode in the creation of a pattern of accompaniment data in a guitar tone, the guitar tone is set. Then, the keyboard is performed to create an accompaniment pattern of a guitar tone, which is then stored in a memory. The mode is then changed to the general performance mode and a performance is given on the keyboard to generate a melody part, for example, of a piano tone and the created accompaniment part of a guitar tone is audibly generated by automatic performance.

A desired accompaniment pattern can rarely be created in a single operation. Generally, the pattern creation is repeated several times to obtain a finished desired accompaniment pattern. However, in the conventional musical sound editing apparatus, tone setting in the general performance mode is unrelated to that in the pattern create mode as a pattern sequencer. Thus, creation of a pattern of accompaniment data is very complicated.

For example, when a pattern of accompaniment data of a guitar tone is created in the pattern create mode, (1) a tone select switch is turned on to set a guitar tone to create the pattern, (2) the mode is then changed from the pattern create mode to the general performance mode to perform in the created pattern, and (3) when the mode is again changed from the general performance mode to the pattern create mode, the tone select switch is again required to be turned on to set the guitar tone. In this case, even if the tone of the keyboard in the general performance mode is the guitar one, the guitar tone is required to be newly set when the mode is changed from the general performance mode to the pattern create mode. That is, each time the mode is changed from the general performance mode to the pattern create mode in the creation of the accompaniment pattern, the tone select switch is required to be turned on to set the tone for pattern creation, which is very troublesome.

DISCLOSURE OF THE INVENTION

It is therefore an object of the present invention to provide a musical sound editing apparatus and a recording medium which facilitate creation of a pattern of accompaniment data in conjunction with tone setting in the general performance mode and the pattern create mode.

In order to achieve the above object of the present invention, according to the present invention, there is provided an musical sound editing apparatus comprising: mode selecting means for selecting one of a general performance mode for performing a melody generally and a pattern create mode for creating a pattern of accompaniment; specifying means for specifying a channel for creating the pattern of accompaniment from among a plurality of channels in which a corresponding plurality of tone data are specified; and musical sound controlling means, responsive to the mode selecting means selecting the pattern create mode, for controlling generation of a musical sound based on specified tone data in the channel specified by the channel specifying means.

According to another aspect of the present invention, there is provided a recording medium which prestores a computer-readable musical sound editing program comprising the steps of selecting one of a general performance mode for performing a melody generally and a pattern create mode for creating a pattern of accompaniment, specifying a channel for creating the pattern of accompaniment from among a plurality of channels in which a corresponding plurality of tone data are specified; and in response to said selecting step, controlling generation of a musical sound based on specified tone data in the channel specified in the channel specifying step.

Thus, according to the above arrangement, when the mode is changed from the general performance mode to the pattern create mode, the tone is changed automatically from that in the general performance mode to that of a channel specified by the channel specifying means. Thus, creation of a pattern of accompaniment data is facilitated in conjunction with tone setting in the general performance mode and the accompaniment pattern create mode.

BRIEF DESCRIPTION OF THE DRAWINGS

FIGS. 20A–F illustrates a transition of data in the memory of the second embodiment.

DESCRIPTION OF THE PREFERRED EMBODIMENTS

Figure 1:
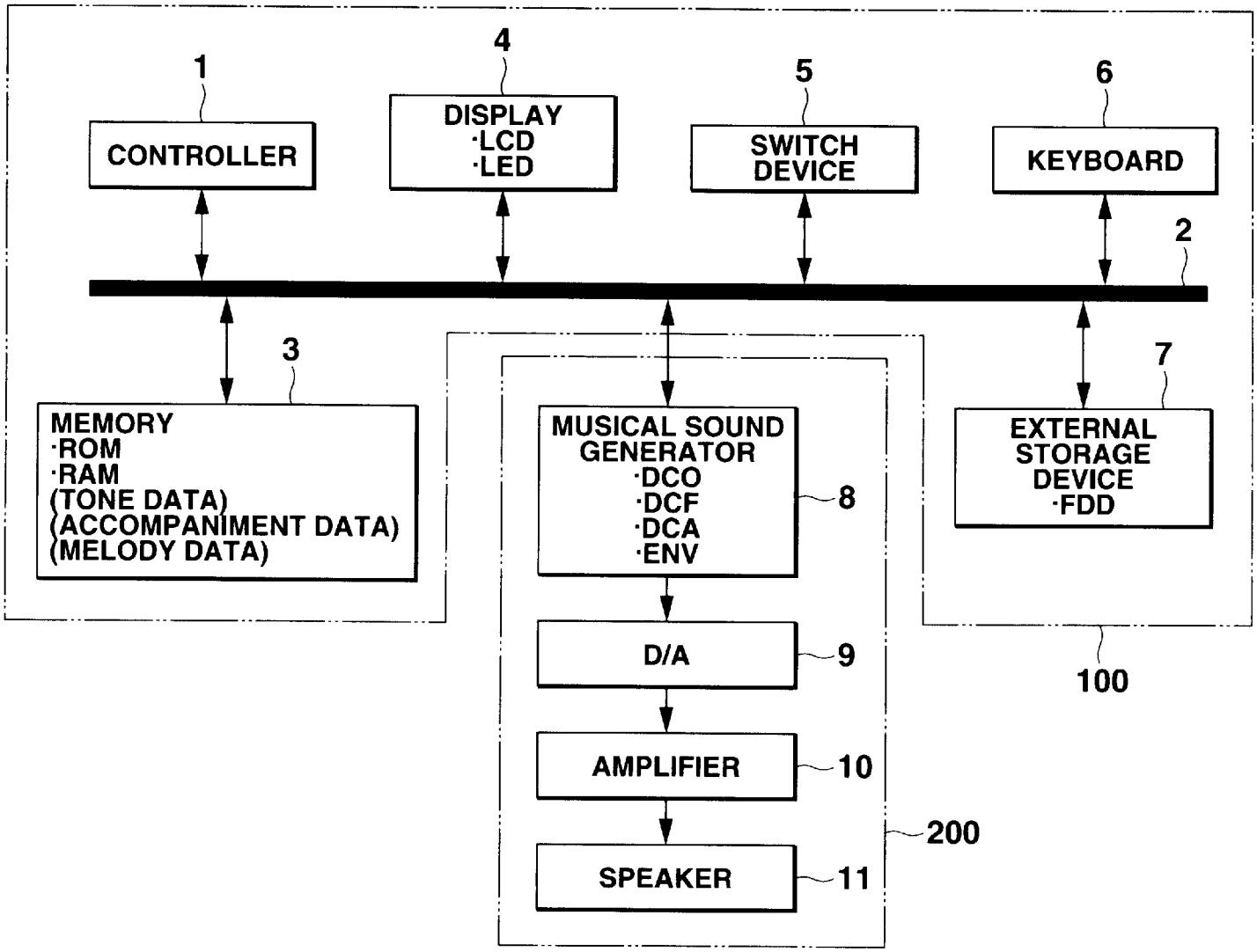
FIG. 1 is a block diagram of a system of a musical editing apparatus and a sound source of each of embodiments of the present invention.

The first and second embodiments of the musical sound editing apparatus according to the present invention will be described with reference to the accompanying drawings. FIG. 1 is a block diagram of a system of each of the two embodiments of the inventive musical sound editing apparatus. The musical sound editing apparatus 100 has a controller 1 which includes a CPU connected through a system bus 2 to a memory 3, a display 4, a switch device 5, a keyboard 6 and an external storage device 7 to control all the elements by sending/receiving commands/data to/from those elements. The controller 1 is connected by a MIDI telecommunication cable to a musical sound generator 8 of a sound source 200 to control generation of a musical sound from the musical sound generator 8.

The memory 3 comprises of a ROM and a RAM in which a musical sound editing program executed by CPU 1, tone data required for generating musical sounds, accompaniment data for performing automatic accompaniment, demonstrate melody, melody data created by a sequencer, etc., are stored. Prepared tones to be created are a "piano", an "organ", a "guitar", a "flute", a "sax" and others.

To this end, the switch device 5 includes a tone select switch (not shown) which selects a tone, a mode select switch which selects any one of a general performance mode and a pattern create mode (pattern sequencer function mode) for creating a pattern of accompaniment data, and a channel select switch for selecting one of current channels for pattern creation.

The keyboard device 6 comprises a keyboard of white and black keys corresponding to respective pitches and a matrix circuit for scanning depressed and released keys of the keyboard to detect depressed and released keys in accordance with key scan signals output from the controller 1 and to input corresponding pitch data and velocity data to the controller 1.

The display 4 comprises of a LCD (liquid Crystal Display) and a LED (Light Emitting Diode) to display an apparatus status. The external storage device 7 is composed of a floppy disk drive (FDD) or another disk drive which is used to write information in the memory 3 to the floppy disk or other external recording mediums.

The musical sound generator 8 of the sound source 200 is comprises a DCO, a DCF, a DCA and an ENV (Envelope Generator) which receive MIDI data from the controller 1 to generate a corresponding musical sound signal. The musical sound signal is then converted by a D/A converter 9 connected to the musical sound generator 8 to an analog signal, which is then subjected to a filtering/amplifying process of an amplifier 10, and output audibly from a speaker 11.

Figure 2A:
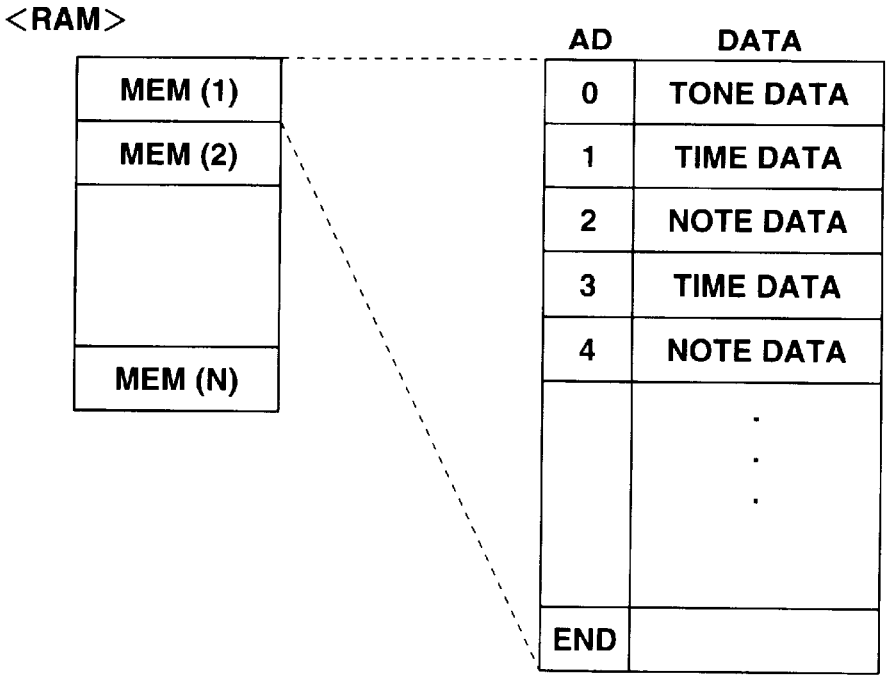
FIG. 2A illustrates data in areas of a memory of the musical sound editing apparatus.
Figure 2B:
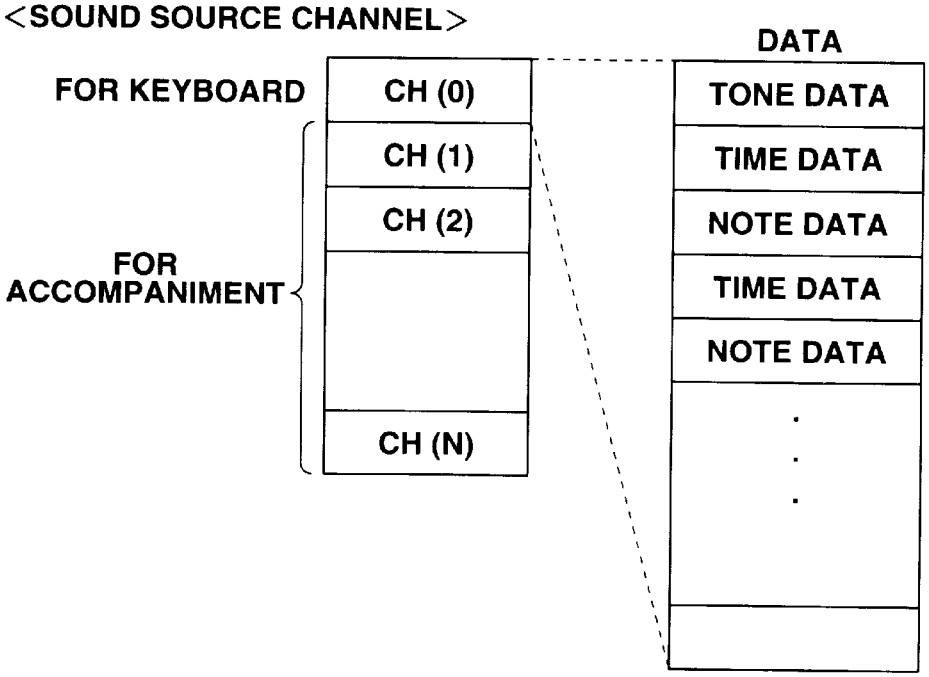
FIG. 2B illustrates data of a plurality of channels in the sound source.

FIG. 2A shows data stored in storage areas MEMs (1)–(N) of the RAM of the memory 3. FIG. 2B shows data stored in channels (1)–(N) of the musical sound generator 8. As shown, data in the respective MEMs and the respective channels are in corresponding relationship, and comprise tone data, time data and note data (note on or off data).

When a command to generate or mute a musical sound is given, data in an area MEM of the RAM is stored in a corresponding channel of the musical sound generator 8 by a music sound generating or muting command from the controller 1. A channel (0) is specified for generation of a musical sound by the keyboard on a real time basis and has no counterpart in the areas of the RAM.

The RAM also includes a start flag STF which is inverted by turning on a start switch, a mode flag MF which is inverted by depressing a mode select switch, a channel flag CHF which is inverted by turning on a channel select switch, a register CURRENT for setting a current channel number indicative of a channel from which a pattern of accompaniment data is created, registers TONE and KTONE in which tone data is set, a register NOTE in which pitch data is set, a register VELOCITY in which velocity data is set, a register TIME which is incremented in response to a timer interrupt, a pointer register, and other areas.

Figures 14A, 14B, 14C, 14D, 14E, 14F:
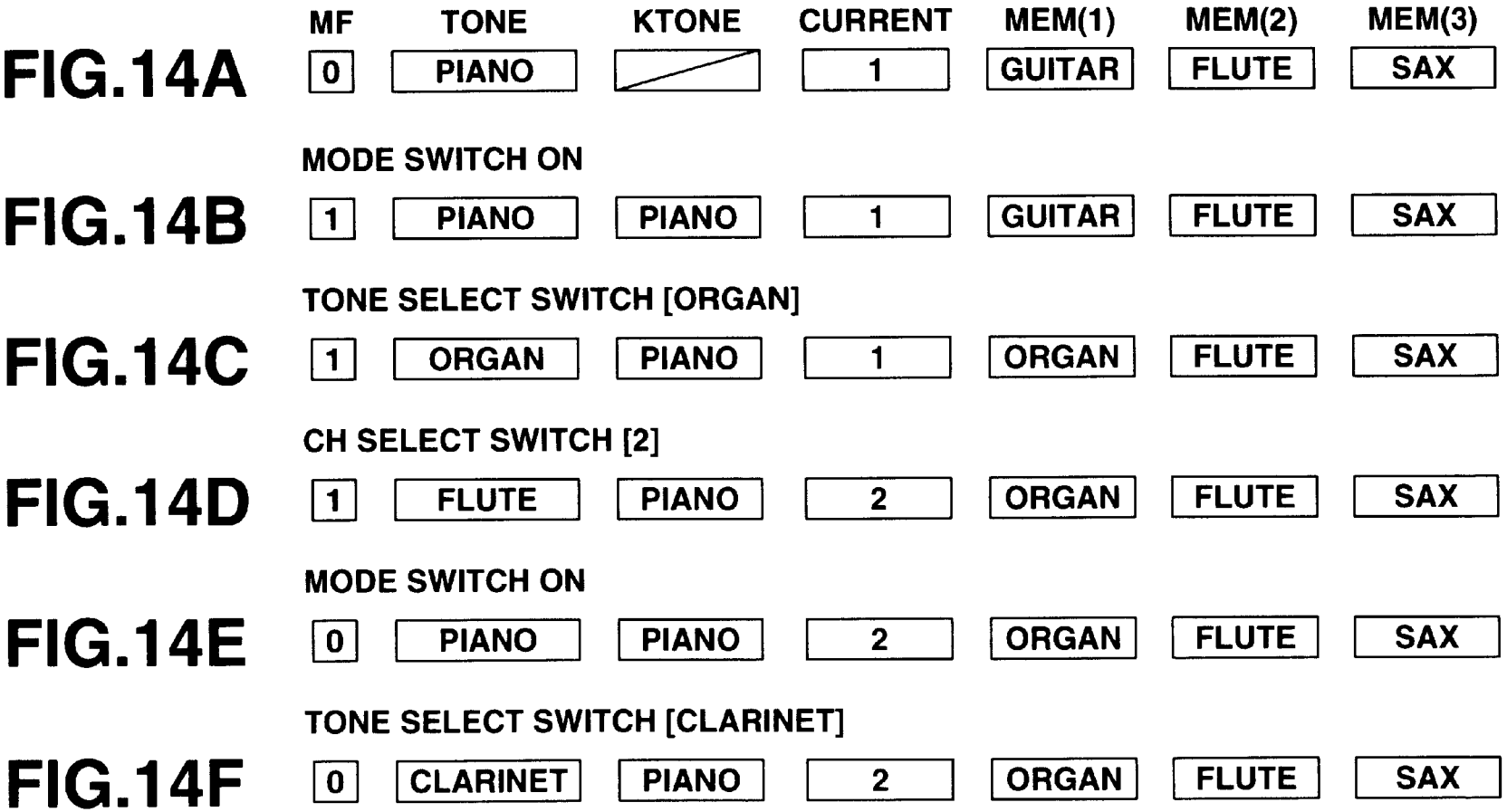
FIGS. 14A–F illustrate a transition of data in a memory of the first embodiment.
Figure 15:
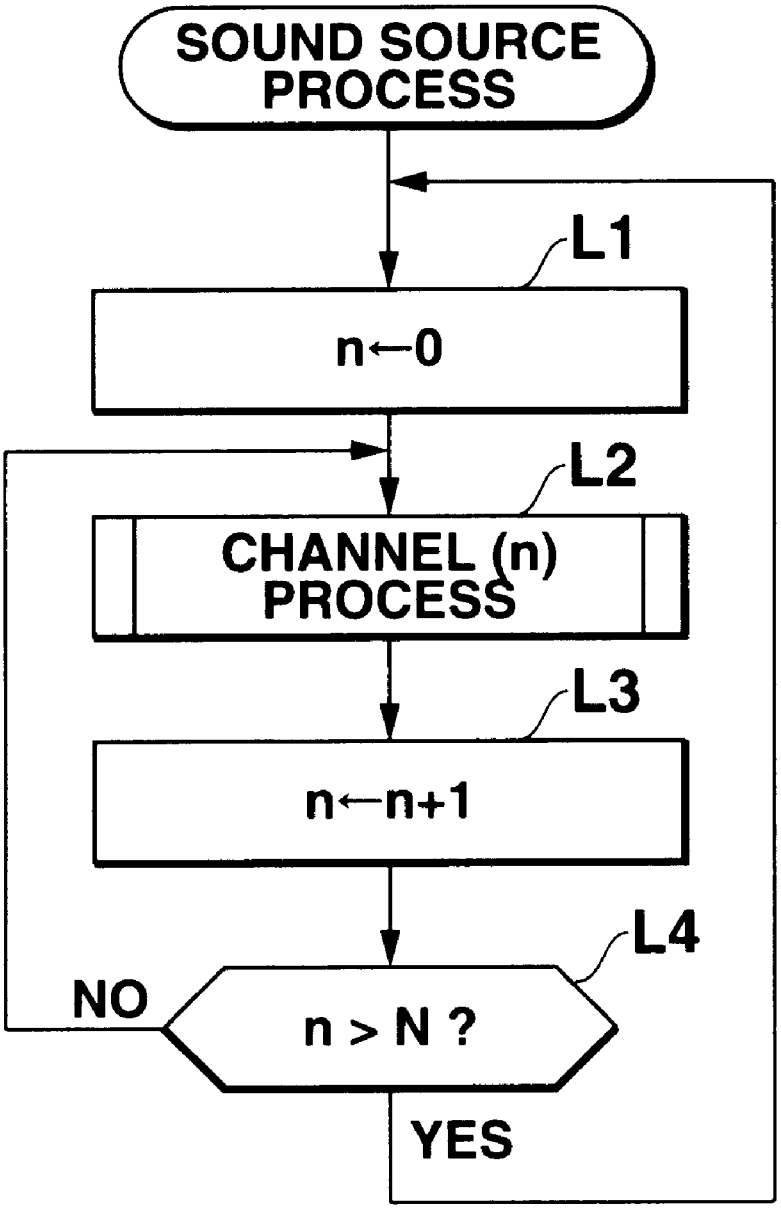
FIG. 15 is a main flowchart of operation of a sound source of the first embodiment.
Figure 16:
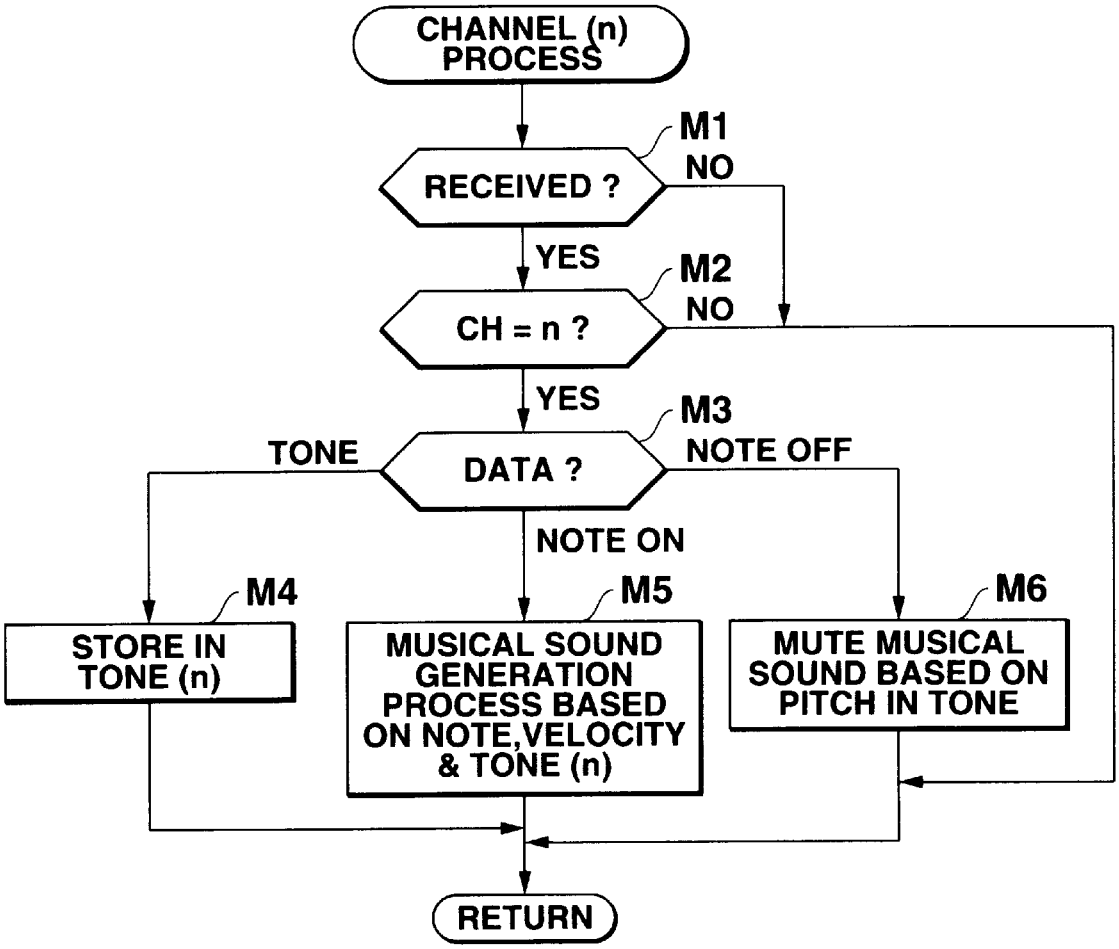
FIG. 16 is a flowchart of a channel process of FIG. 15.
Figure 17:
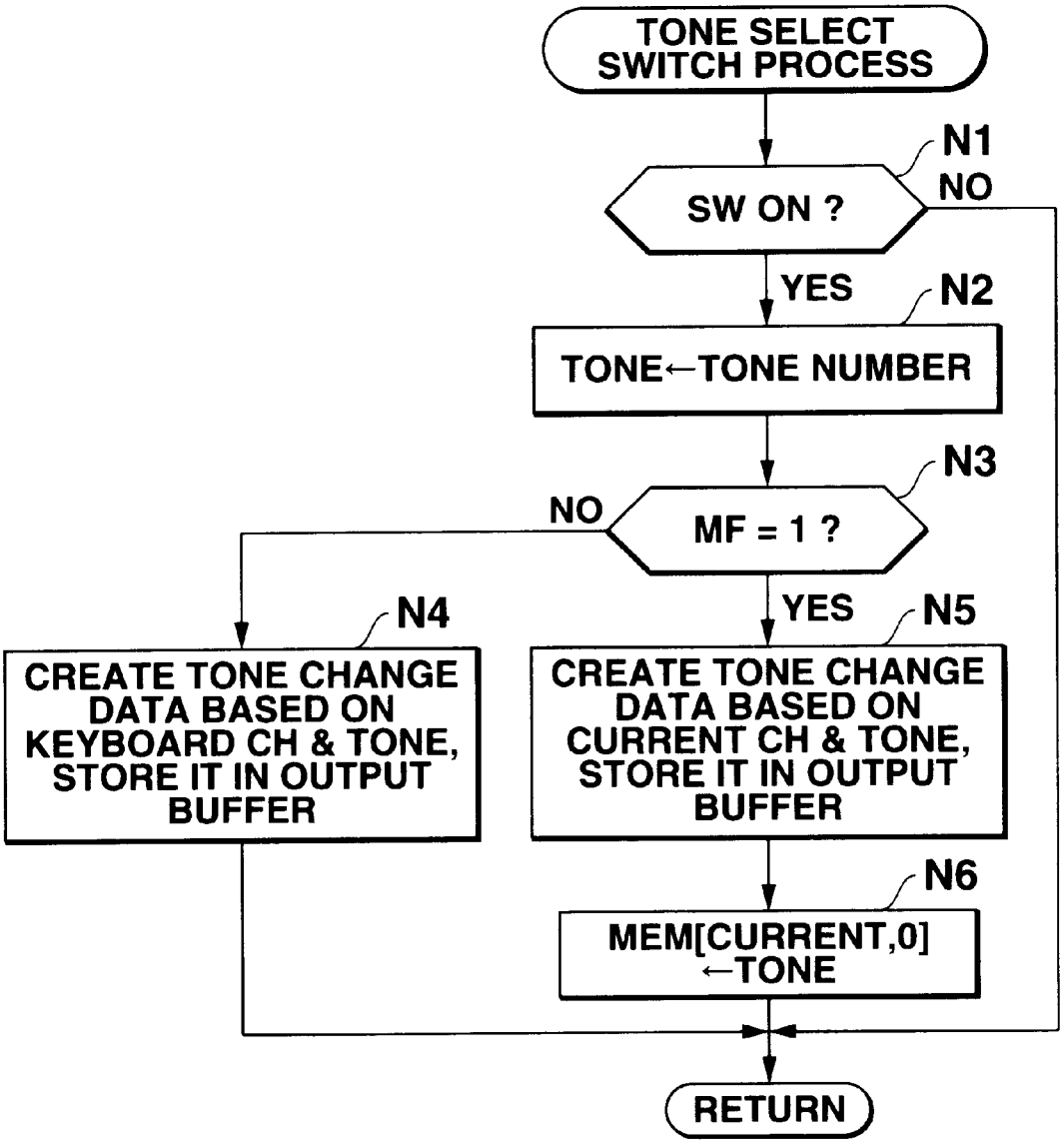
FIG. 17 is a flowchart of a tone select switch process of a second embodiment.

Operation of the first embodiment of the musical sound editing apparatus 100 will be desired with reference to a flowchart of FIGS. 3–13, a transition of data in a predetermined area of the RAM of FIG. 14, and a flowchart of operation of the sound source 200 of FIG. 15–17.

Figure 3:
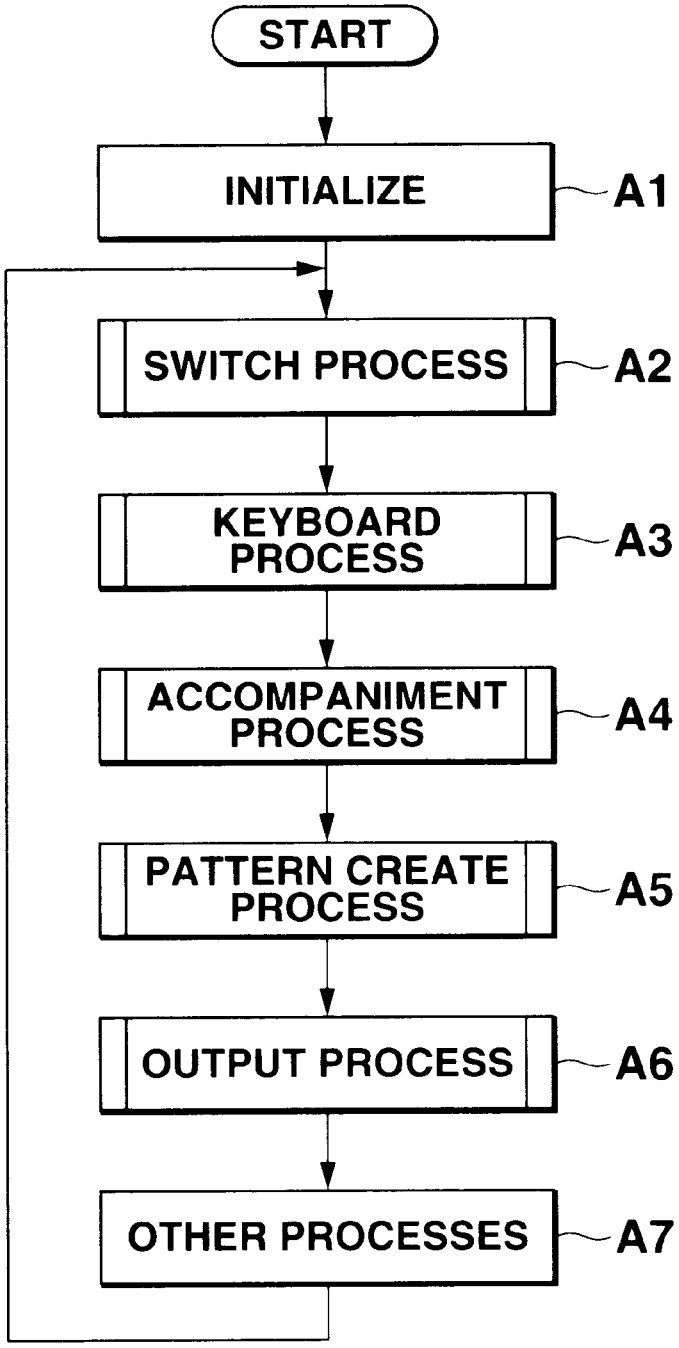
FIG. 3 is a main flowchart of operation of a first embodiment of the inventive musical sound editing apparatus.

FIG. 3 shows a main flow of the operation of the musical sound editing apparatus 100 of FIG. 3, which includes a predetermined initialize process (step A1), a switch process (step A2), a keyboard process (step A3), an accompaniment process (step A4), a pattern create process (step A5), an output process (step A6), and another process (step A7) where the steps A2–A7 are executed repeatedly as requested.

Figure 4:
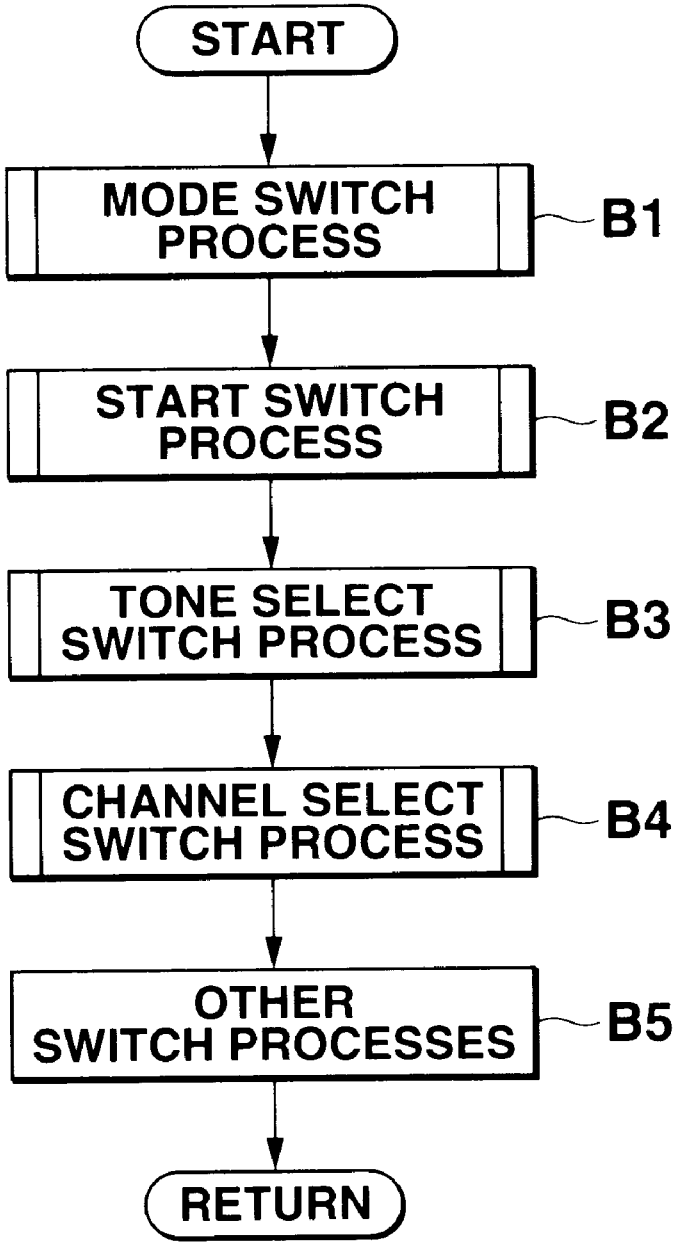
FIG. 4 is a flowchart of a switch process of FIG. 3.

FIG. 4 shows a flow of the switch process (step A2), in which a mode switch process (step B1), an automatic accompaniment start switch process (step B2), a tone select switch process (step B3), a channel select switch process (step B4), and another switch process (step B5) are performed and then the control returns to the main flow.

Figure 5:
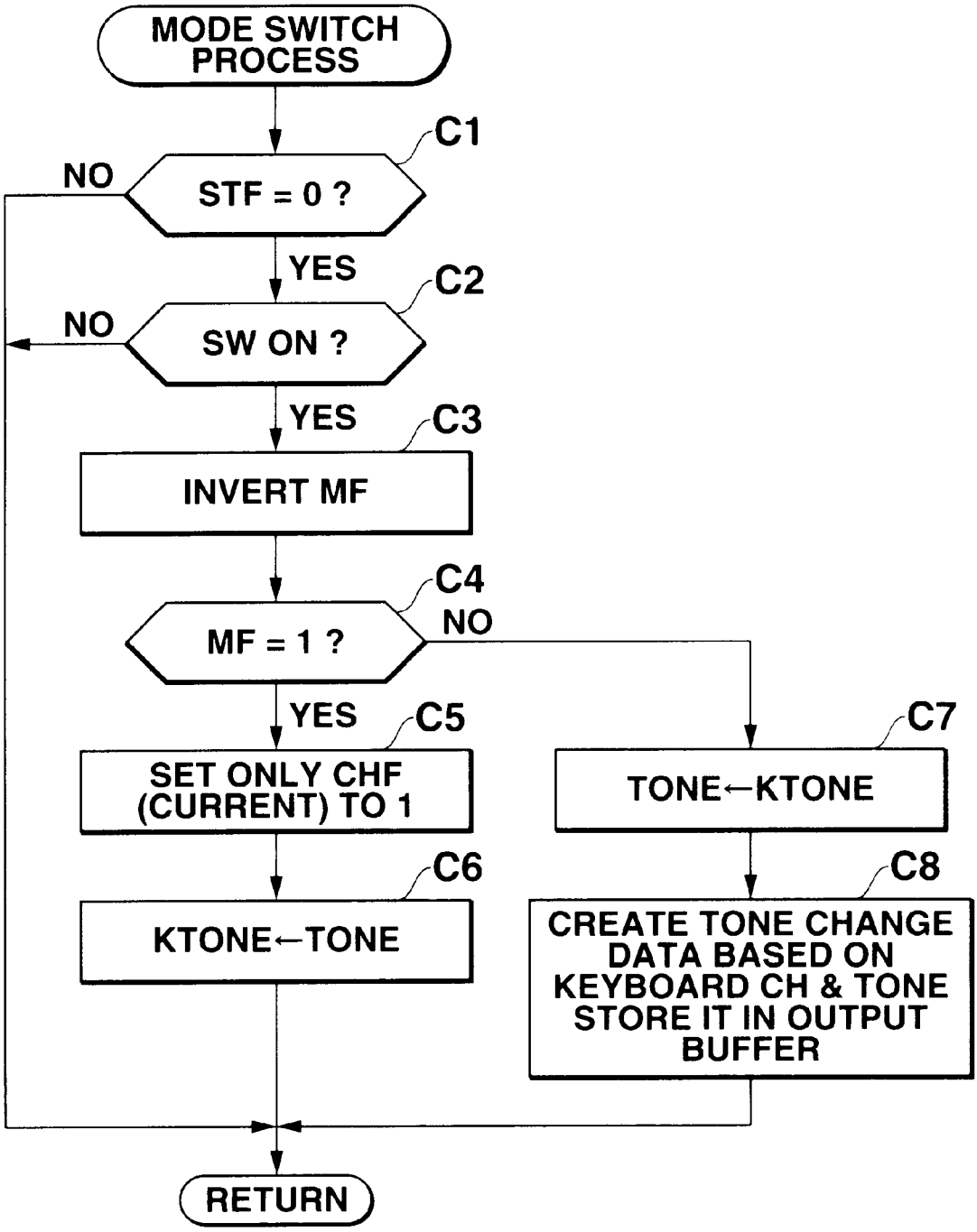
FIG. 5 is a flowchart of a mode switch process of FIG. 4.

FIG. 5 illustrates a flow of the mode switch process (step B1) of FIG. 4 in which it is determined whether the start flag STF is 0 (step C1). If the STF is 1 (automatic accompaniment), this process is terminated and the control returns to the flow of FIG. 4. If the STF is 0, it is then determined whether the mode switch is turned on (step C2). If otherwise, this process is terminated and the control returns to the flow of FIG. 4.

When the mode switch is turned on in step C2, the mode flag MF is then inverted (stop C3). It is then determined whether the MF is inverted from 0 to 1 (step C4). If it is, only a channel flag CHP (CURRENT) for a current channel by which a current channel by which a pattern is created creates a pattern is set to 1 (step C5). The data set in the register TONE is then set in the register KTONE for the keyboard tone data (step C6).

When the mode switch is turned on in a state where, for example, (1) the MF is 0, (2) tone data in the TONE is "piano", or (3) any particular tone data or no tone data is set in the KTONE, as shown in FIG. 14A, the MF is inverted to 1 and the tone data "piano" in the TONE is set in the KLONE, as shown in FIG. 14B. After the tone data is set in the KTONE in step C6, this process is terminated and the control returns to the flow of FIG. 4.

When the MF is 0 in step C4, the tone data in the KTONE is set in the TONE (step C7). When the mode switch is turned on in a state where (1) the MF is 1, (2) the tone data in the TONE is "flute" and (3) the tone data in the KTONE is "piano", for example as shown in FIG. 14D, the MF is inverted to 0 and the tone data "piano" in the KTONE is set in the TONE, as shown in FIG. 14E. Then, the sound source creates tone change data based on tone data in the TONE and data in the channel (0) specified or generation of a musical sound by the keyboard, and then stores it in the output buffer (step C8). The process is then terminated and the control returns to the flow of FIG. 4.

Figure 6:
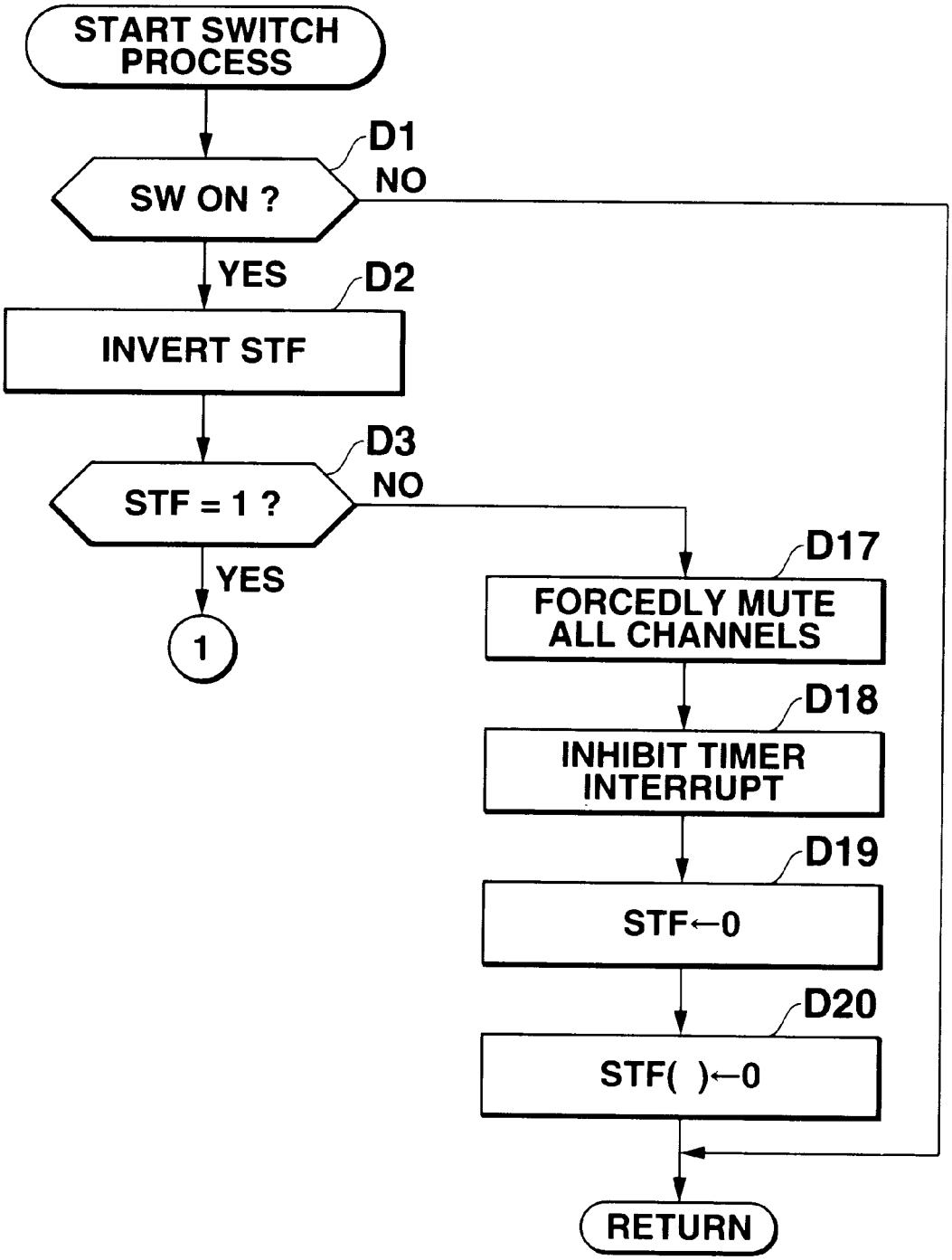
FIG. 6 is a flowchart of a part of a start switch process of FIG. 4.
Figure 7:
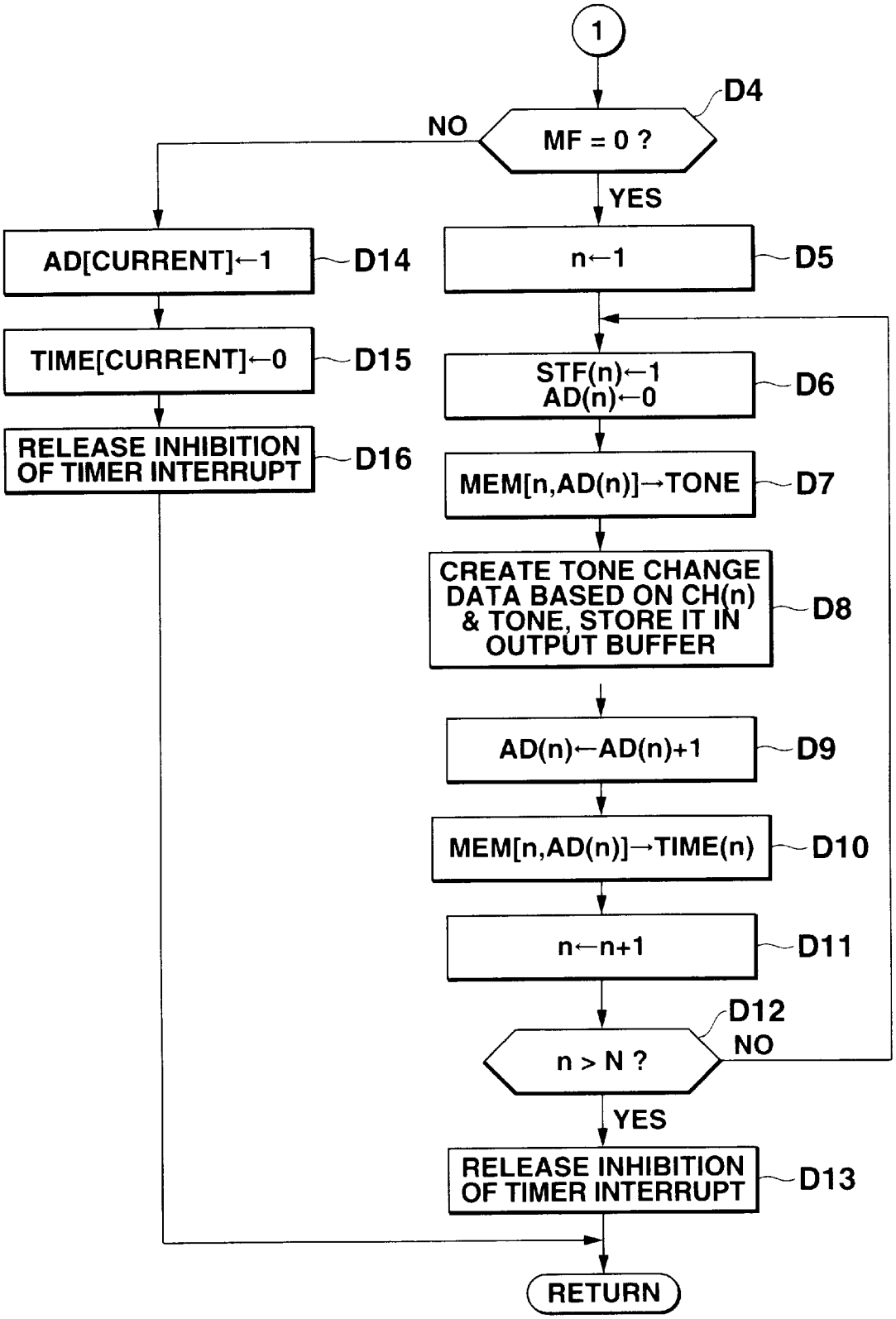
FIG. 7 is a flowchart of the remainder of FIG. 6.

FIGS. 6 and 7 are combined together to illustrate the start switch process in step B2 of the FIG. 4 switch process. In this process, it is determined whether the automatic accompaniment start switch is turned on (step D1). If otherwise, this process is terminated and the control returns to the flow of FIG. 4. When the start switch is turned on, the start flag STF is inverted (step D2). It is then determined whether the STF is 1 (step D3).

When the STF is 1, it is then determined whether the MF is 0 in FIG. 7 (step D4). If it is, a pointer n which specifies a channel of the sound source is set to 1 (step D5), and the pointer n is then incremented sequentially while the subsequent steps are repeated. That is, the start flag STF (n) for each channel specified by the pointer n is set sequentially to 1 and an address AD (n) is set to 0 (head address) (step D6). Tone data in a MEM (n,0) is then set in the TONE (step D7). Then, the sound source creates note change data based on tone data in TONE and channel (n) data specified for generation of a musical sound, and stores it in the output buffer (step D8).

The AD (n) is then incremented (step D9), and data in the MEM (n, A0 (n), is then set in the TIME (n) (step D10). Then, n is incremented (step D11) and it is determined whether n has exceeded a maximum value N (step D12). If n is less than N, the control passes to step D6, where required ones of the above-mentioned steps D6–D12 are repeated When n has exceeded N in step D12, a timer interrupt is released from its inhibition (step D13). This process is then terminated and the control returns to the flow of FIG. 4 As a result, as shown in FIG. 2B, tone data at the respective first addresses and time data at the respective next addresses in all the accompaniment channels (1)–(N) are overwritten respectively onto the tone data at the corresponding first addresses and time data at the corresponding next addresses in the corresponding areas MEMS (1)–(N) of the RAM.

When the MF is 1 in step D4, the address of the current channel specified for creating the pattern is set to 1(step D14). Zero is then set in the time register TIME of the current channel for clearing purposes (step D15). The timer is then released from its interrupt ignition (step D16) and the process is terminated and the control returns to the flow of FIG. 4.

When the STF is 0 in step D3 of FIG. 6, all the channels are forcedly muted (step D17), and the timer interrupt is inhibited (step D18). The STF is then reset to 0 (step D19), and the STFs corresponding to all the channels are reset to 0 (step D20). This process is then terminated and the control returns to the flow of FIG. 4

Figure 8:
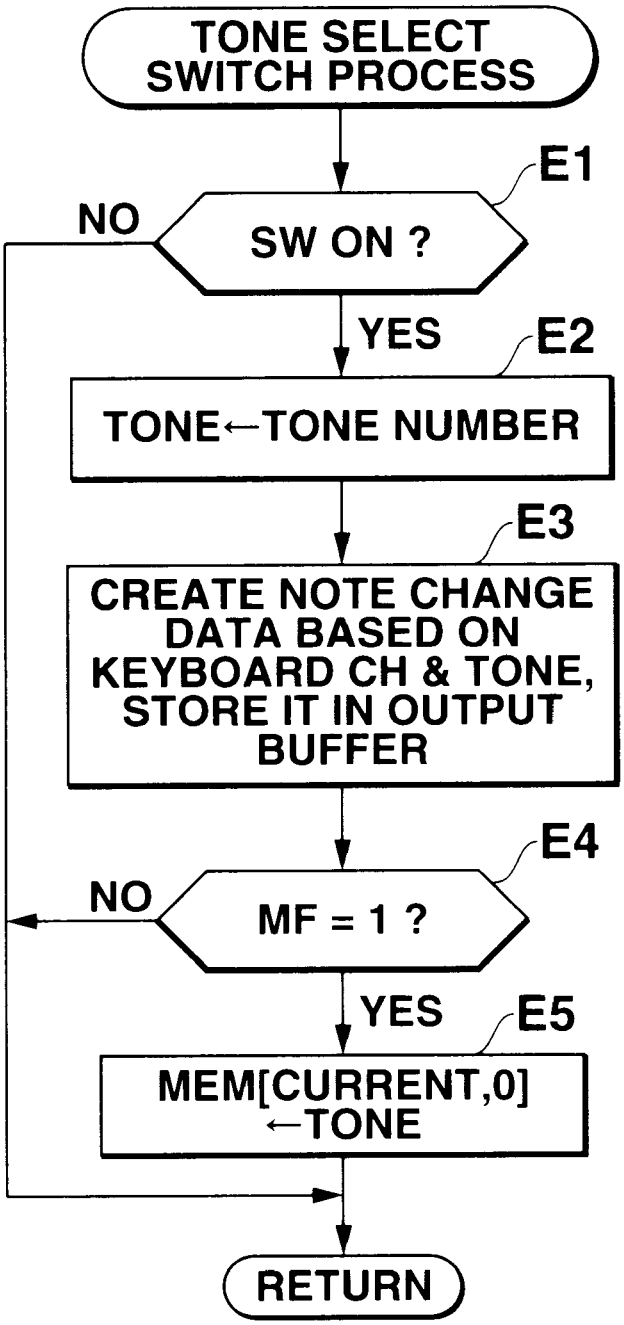
FIG. 8 is a flowchart of a tone select switch process of FIG. 4.

As shown in FIG. 8, the tone select switch process in step B3 of FIG. 4 determines whether the tone select switch is turned on (step E1). If otherwise, this process is terminated. If the tone select switch is turned on, its tone data (tone number) is stored in the register TONE (step E2). The sound source then creates tone change data based on tone data in the TONE and data in the channel (0) specified for generation of a musical sound by the keyboard, and stores it in the output buffer (step E3).

When a tone select switch for "clarinet" is turned on in a state where, for example, (1) the MF is 0, (2) the tone data in the TONE is "piano", and (3) tone data in MEMs (1)–(3) are "organ", "flute" and "sax", respectively, as shown in FIG. 14E, the tone data in the TONE is changed from "piano" to "clarinet", as shown in FIG. 14 In this case, the tone data in the MEMs (1)–(3) are not changed.

It is then determined whether the MF is 1 (step E4). If the MF is 0, this process is terminated and the control returns to the flow of FIG. 4. If the MF is 1, tone data in the TONE is stored in a MEM (CURRENT, 0) area of the RAM corresponding to the specified channel (step E5).

When, for example, a tone select switch "organ" is turned on in a state where, for example, (1) the MF is 1, (2) the tone data in the TONE is "piano", (3) the current channel is 1, and (4) the tone data in the MEMs (1)–(3) are "guitar", "flute" and "sax", respectively, as shown in FIG. 14B, the tone data in the TONE is changed from "piano" to "guitar" as shown in FIG. 14C, and the tone data in a MEM (1) coloring to the current channel is changed from "guitar" to "organ". After processing in step E5, this process is terminated and the control returns to the flow of FIG. 4.

Figure 9:
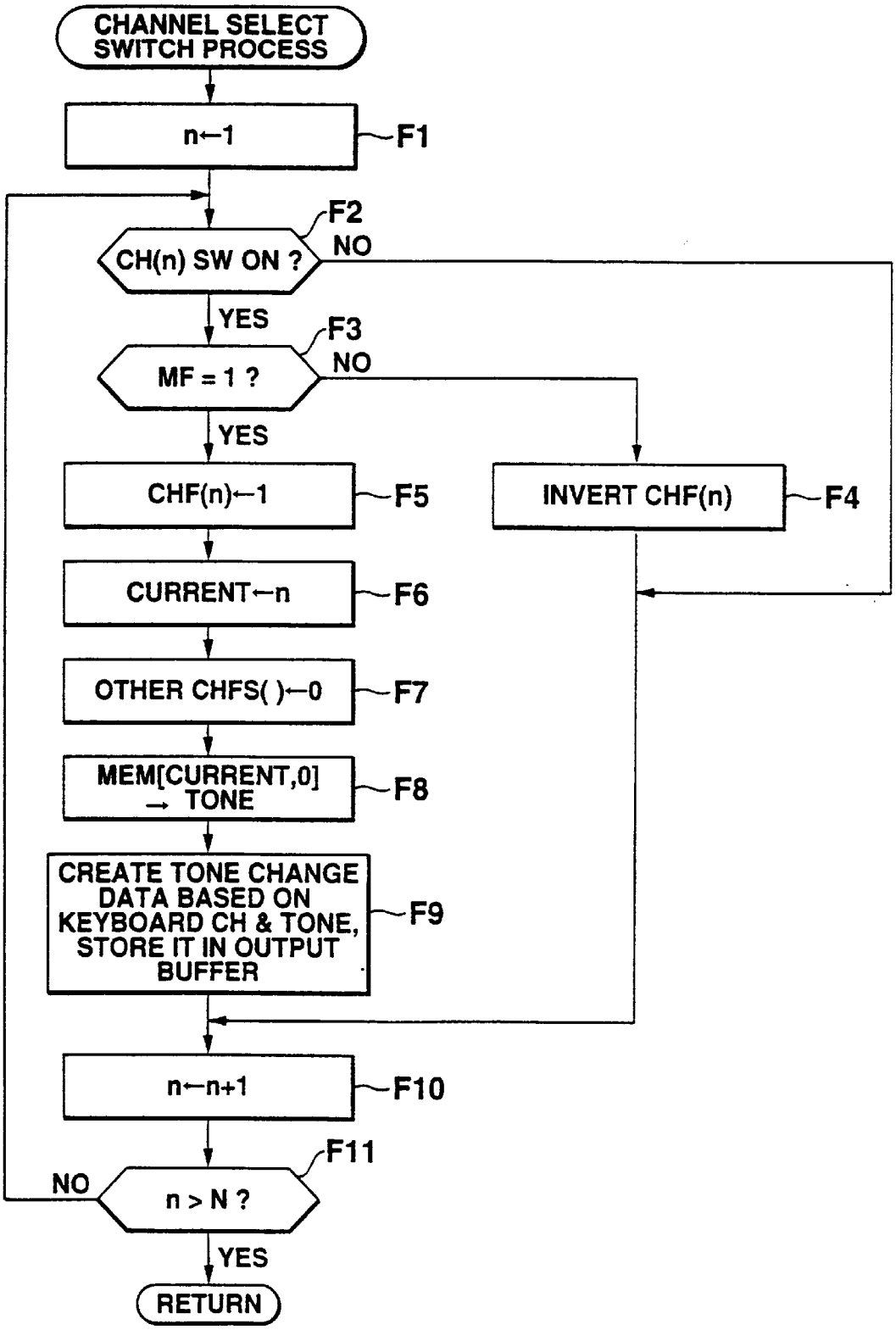
FIG. 9 is a flowchart of a channel select switch process of FIG. 4.

FIG. 9 shows the channel select switch process in step B4 of FIG. 4. In this process, the pointer n which specifies a channel is set to 1 (step F1), and sequentially incremented while the following looping process is repeated.

That is, it is determined whether the channel (n) switch is turned on (step F2). If it is, it is then determined whether the MF is 1 (step F3). If MF is 0, a channel flag CHF (n) is then inverted (step F4). If the CHF (n) is inverted to 1, the channel (n) becomes a sound produce channel. When the CHF (n) is inverted to 0, the channel (n) becomes a mute channel.

When the MF is 1 in step F3, the CHF (n) is set to 1 (step F5), and the register CURRENT indicative of a current channel is set to n (step F6). The CHFs (n) of channels other then the channel n are reset to 0 (step F7).

Tone data in the MEM (CURRENT, 0) corresponding to the current channel is stored in the TONE (step F8). Then, the sound source creates tone change data based on the tone data in the TONE and the data in the channel (0) specified for generation of a musical sound by the keyboard, and then stores it in the output buffer (step F9). Then or when the channel (n) switch is not turned on in step F2 or when the CHF (n) is inverted in step F4, the pointer n is incremented (step F10). It is then determined whether n has exceeded the maximum value N (step F11). If otherwise, the control passes to step F2, where required ones of the above steps F2–F11 are repeated. If n has exceeded N, the process is terminated and the control returns to the flow of FIG. 4.

When the channel select switch "2" is turned on in a state where, for example as shown in FIG. 14C, (1) the MF is 1, (2) the tone data in the TONE is "organ", and (3) the tone data in the MEMs (1)–(3) are "organ", "flute" and "sax", respectively the tone data in the TONE is changed from "organ" to "flute", as shown in FIG. 14D.

Figure 10:
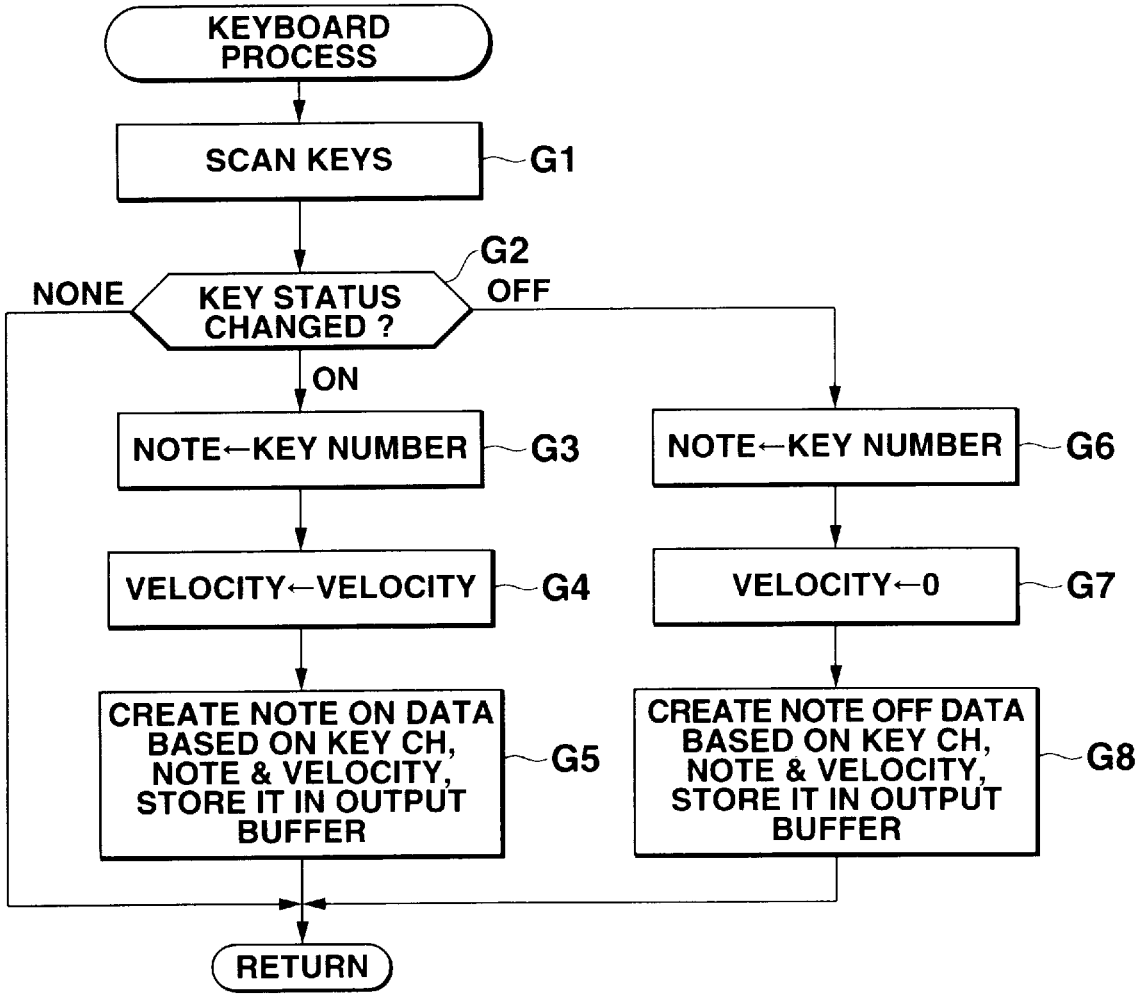
FIG. 10 is a flowchart of a keyboard process of FIG. 3.

FIG. 10 illustrates the keyboard process of the main flow of FIG. 3. First, the keys are scanned (step G1) and it is then determined whether there is any change in the key status (step G2). If otherwise, the process is terminated and the control returns to the main flow FIG. 3. If there is a change in the key status which includes key depression, the key number or pitch data is stored in the register NOTE (step G3), and velocity data is stored in the register VELOCITY (step G4). Then, note-on data is created based on the channel (0) data for generation of a musical sound by the keyboard, the pitch data in the NOTE, and the data in the VELOCITY, and then stored in the output buffer (step G5). The process is then terminated and the control returns to the main flow FIG. 3.

When there is a change in the key status in step G2 including a release of key depression, the key number or pitch data is stored in the register N (step G6), and 0 is stored in the register VELOCITY (step G7). Then, note-off data is created based on data in the channel (0) for generation of a musical sound by the keyboard, the pitch data in the NOTE, and the data in the VELOCITY, and then stored in the output buffer (step G8). The process is then terminated and the control returns to the main flow of FIG. 3.

Figure 11:
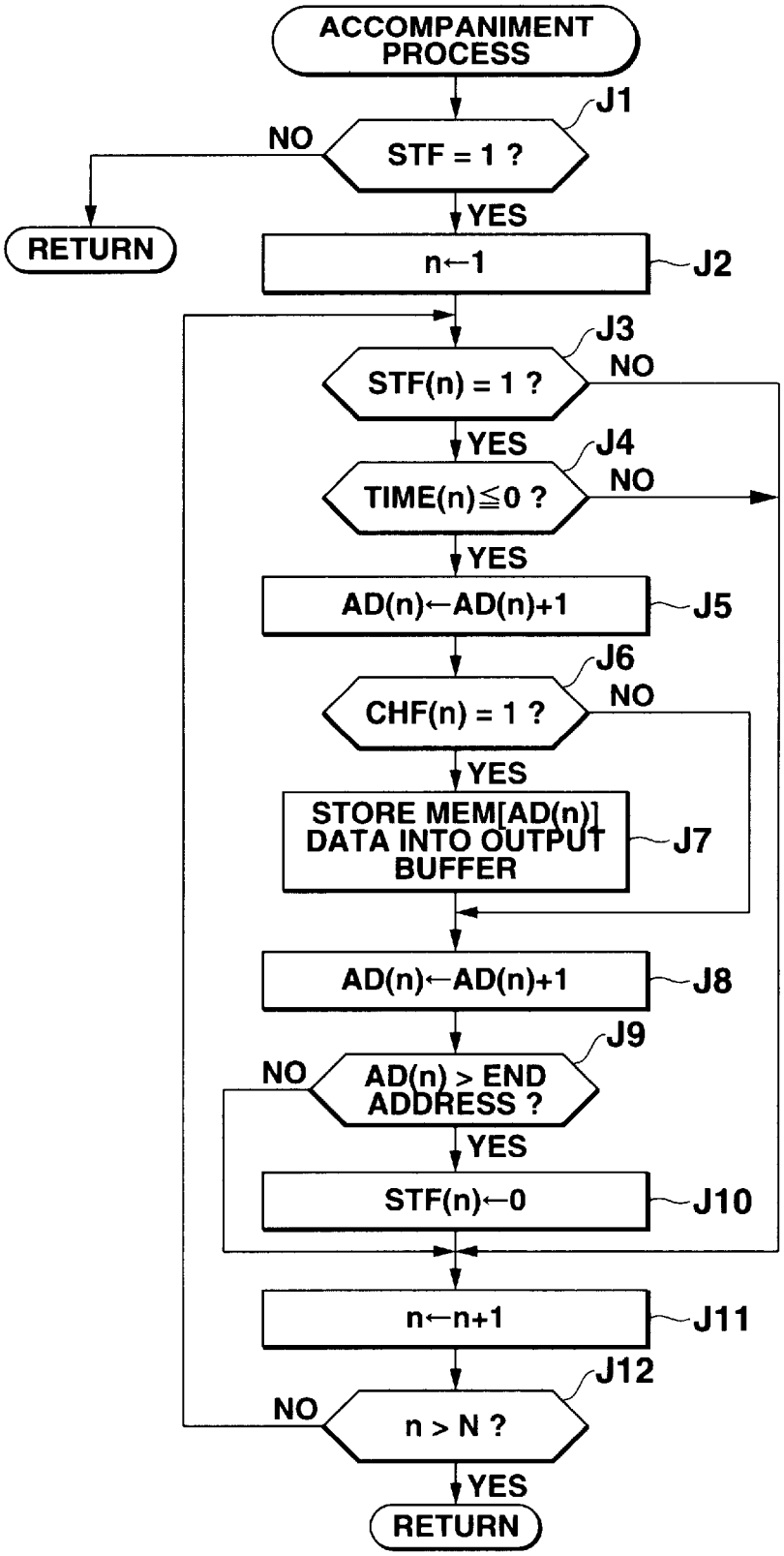
FIG. 11 is a flowchart of an accompaniment process of FIG. 3.

FIG. 11 shows an accompaniment process in the main flow of FIG. 3. First, it is determined whether the start flag STF is 1 (step J1). If it is 0, this process is terminated and the control returns to the main flow of FIG. 3. If the STF is 1, the pointer n which specifies a channel is set to 1 (step J2), and then incremented sequential while the following looping process is repeated.

That is, it is determined whether the start flag STF (n) is 1 for each channel (step J3). If the SWF (n) is 1, it is determined whether the time data in the TIME (n) decrement each time the timer is interrupted has reached 0 or a start time for the accompaniment has arrived (step J4). If it is, AD (n) is incremented to specify the next event data (step J5).

It is then determined whether the channel flag CHF (n) is 1 (musical sound generation channel) (step J6). If it is, data stored in the MEM (A0(n)) is stored in the output buffer (step J7). The AD (n) is then incremented to specify next data (step J8). Also, when the CHF (n) is 0 (mute channel) in step J6, the control passes to step J8, where AD (n) is incremented It is then determined whether AD (n) has exceeded the end address (step J9). If it has, the STF (n) is reset to 0 (step J10). Then, when AD (n) has not exceeded the end address in step J9 or when a TIME (n) has not reached 0 in step J4 or when the STF (n) is 0 in step J3, n is incremented to specify a next channel (step J11).

Then, it is determined whether n has exceeded the maximum value N (step J12). If otherwise, the control passes to step J3, where required ones of the steps J3–J12 are repeated. If n has exceeded N in step J12, the process is terminated and the control returns to the main flow of FIG. 3.

Figure 12:
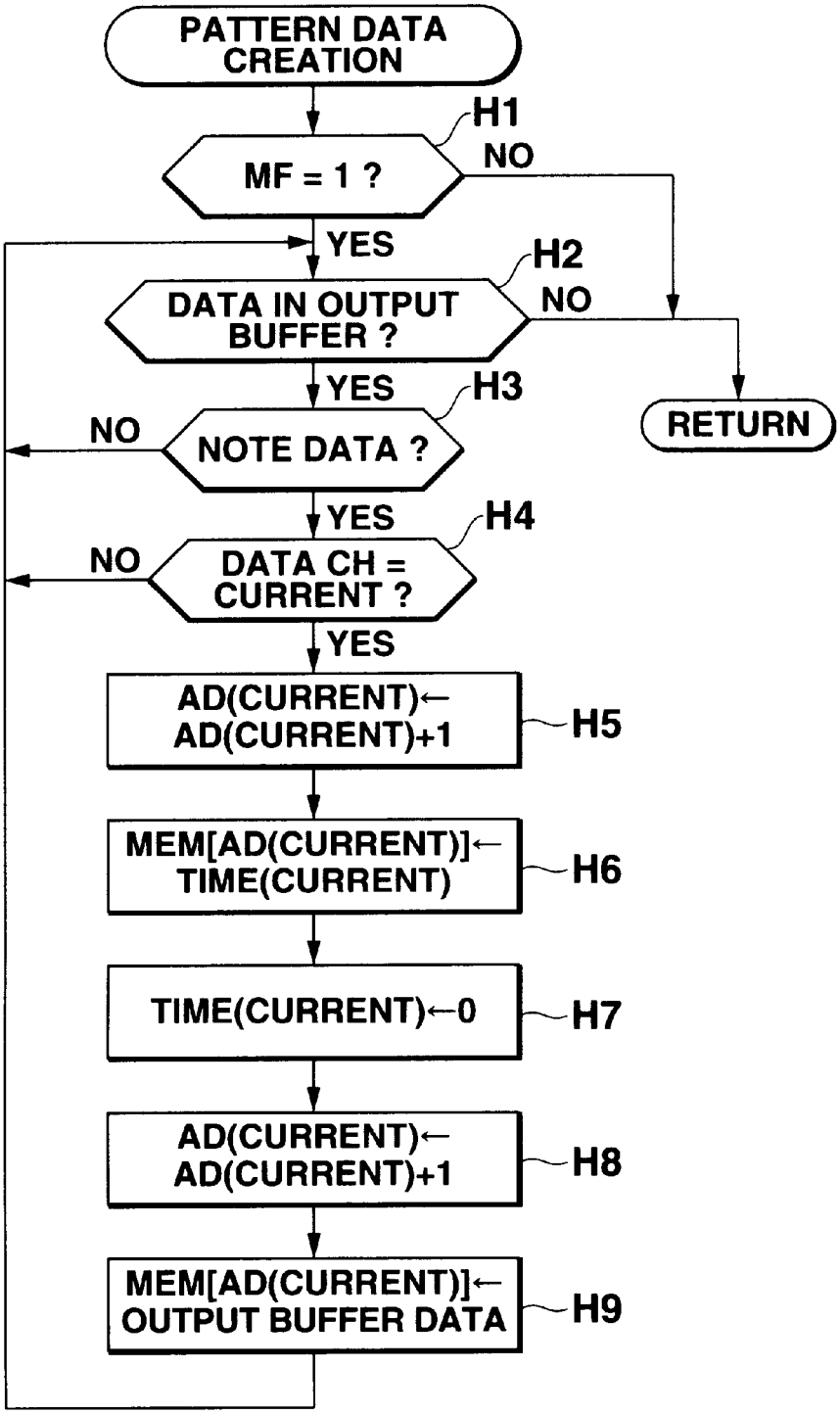
FIG. 12 is a flowchart of a pattern data create process of FIG. 3.

FIG. 12 illustrates the pattern data creating process of the main flow of FIG. 3. First, it is determined whether the mode flag MF is 1 (pattern create mode) (step H1). If the MF is 0 (general performance mode), the process is terminated and the control returns to the main flow of FIG. 3. If the MF is 1, it is then determined whether there is data in the output buffer (step H2).

If there is, it is then determined whether the data is note data (step H3). If it is, it is then determined whether a channel for the note data is a current channel data in the CURRENT (step H4). If it is, an address AD (CURRENT) of the current channel is incremented (step H5).

Then, time data in the TIME (CURRENT) is stored in a storage area MEM [AD (CURRENT)] corresponding to the current channel (step H6). Time data in the TIME (CURRENT) is then cleared to 0 (step H7). AD (CURRENT) is then incremented (step H8), and data in the output buffer is then stored in the MEM (AD (CURRENT)) (step H9).

Then or when the data in the output buffer is not note data in step H3 or when the channel for the note data is not the current channel in step H4, the control passes to step H2, where it is determined whether there is any data in the output buffer. If there is, required ones of the above steps H2–H4 are repeated. If there are no data in the specified address in the output buffer, the process is terminated and the control returns to the main flow of FIG. 3.

Figure 13:
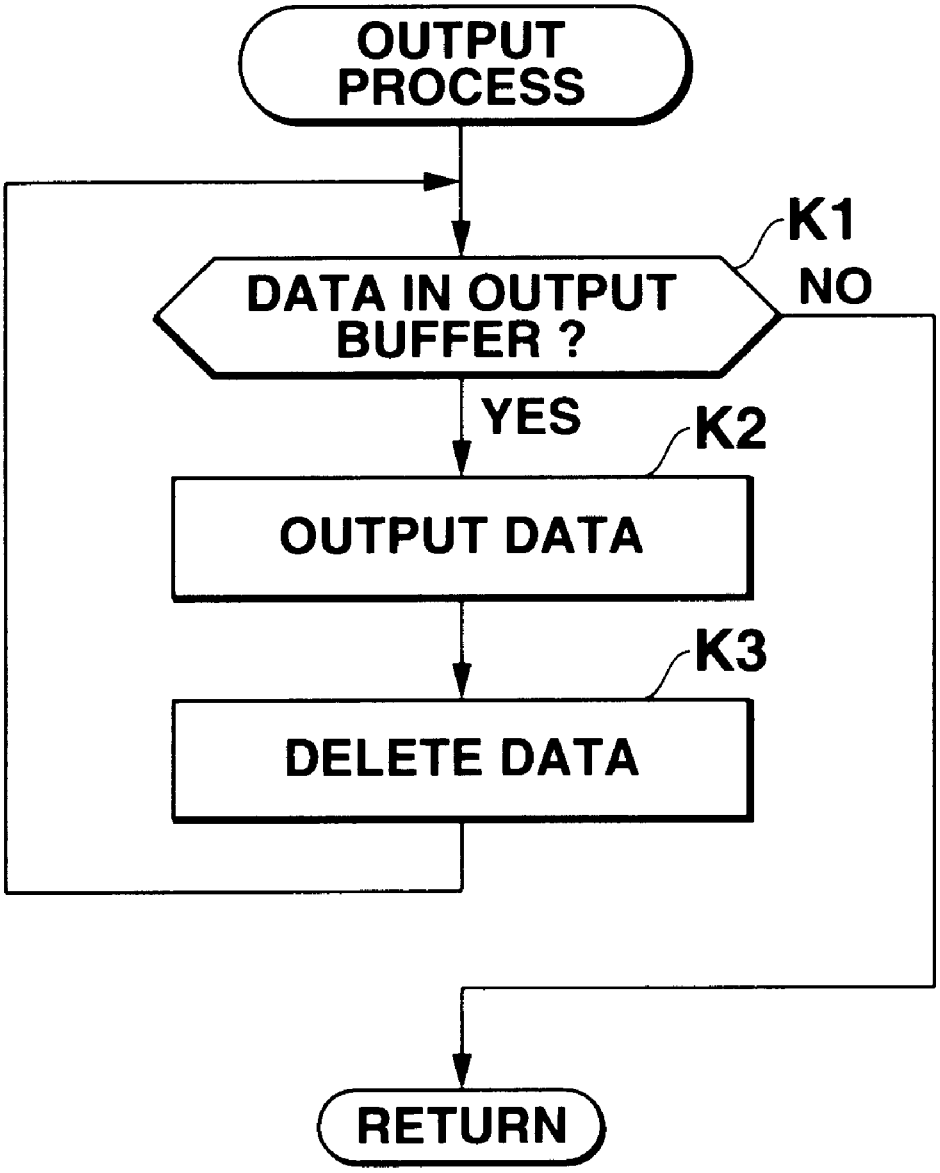
FIG. 13 is a flowchart of an output process of FIG. 3.

FIG. 13 shows the output process of the main flow of FIG. 3. In this process, it is determined whether there is data in the output buffer (step K1). If there is, the data is output to the sound source (step K2). The data is then deleted (step K3). Then, the control passes to step K1, where it is determined whether there is data in the output buffer. If there is not, the process is terminated and the control returns to the main flow of FIG. 3.

FIG. 15 shows a main flow of operation of the sound source 200. The pointer n, which specifies a channel, is set to 0 (step L1). Then, processes for the channel (0)–(n) are sequentially performed, starting with the channel (0) which is specified for generation of a musical sound by the keyboard (step L2). When the process for the channel (n) is completed, n is then incremented to specify a next channel (step L3). It is then determined whether n has exceeded the maximum value N (step L4). If otherwise, the channel (n) process in step U2 is performed. If n has exceeded N, the control passes to step L1, where n is again set to 0, and required ones of the steps L1–L4 are then performed.

FIG. 16 is a flowchart of the channel (n) process of the main flow of FIG. 15. It is determined whether data is received from the musical sound editing apparatus 100 (step M1). If it is, it is then determined whether the channel for the received data is a specified channel (n) (step M2). If otherwise or when there is no received data in step M1, the process is terminated and the control returns to the main flow of FIG. 15.

If the channel for the received data is a specified channel (n) in step M2, the contents of the received data are then determined (step M3). If the received data is tone data, it is stored in the TONE (n) (step M4). If the received data is note-on data, a musical sound generation press is performed based on pitch data in the NOTE, velocity data in the VELOCITY, and tone data in the TONE (n) (step M5). If the received data is note-off data, a musical sound mute process is performed for muting the musical sound generated based on the pitch data in the NOTE (step M6). After the process in steps M4, M5 or M6, the process is terminated and the control returns to the main flow of FIG. 15.

As described above, according to the first embodiment, when the mode is changed from the general performance mode to the pattern create mode for creating a pattern of accompaniment data, the tone is changed automatically from that in the general performance mode to that in the channel specified by the controller 1 as the channel specifies means. Thus, by correlating the note setting operations in the general performance mode and the pattern create mode, creation of a pattern of accompaniment data is easily carried out.

When the mode is changed from the pattern create mode to the general performance mode by the mode select switch, the tone data set in the general performance mode is transferred from the KTONE to the TONE to thereby control generation of a musical sound based on the tone data set in the general performance mode. Thus, it is not required to restore the original tone in the general performance mode in the mode change.

When tone data is manually changed in the pattern create mode, generation of a musical sound is controlled based on the changed tone data in the channel specified for generation of a musical sound by the keyboard and the tone data in the storage area of the RAM corresponding to the specified current channel is changed to the changed tone data. Thus, the tone set in the pattern create mode in which the melody was produced by the performance on the keyboard and recorded can always be identical to a tone of the recorded melody which may be later performed automatically.

When the specified channel is changed in the pattern create mode, generation of a musical sound is controlled in the channel specified for generation of a musical sound by the keyboard based on tone data in the RAM storage area corresponding to the changed channel. Thus, it is unnecessary to set a tone in a channel for the keyboard each time the pattern create channel is changed.

Operation of a second embodiment of the inventive musical sound editing apparatus 100 will be described based on a flowchart of FIGS. 17–19. A mode switch process, a start switch process and other switch processes of the second embodiment are identical to corresponding ones of the switch process of the first embodiment of FIG. 4. Also, an accompaniment process, a pattern create process, an output process and another process of the second embodiment are identical to corresponding ones of the main flow of the first embodiment of FIG. 3. Processes performed by the sound source 200 of the second embodiment are identical to corresponding ones performed by the sound source of the first embodiment of FIGS. 15 and 16. Thus, further description and illustration of operations of the second embodiment identical to corresponding ones of the first embodiment will be omitted.

Figure 18:
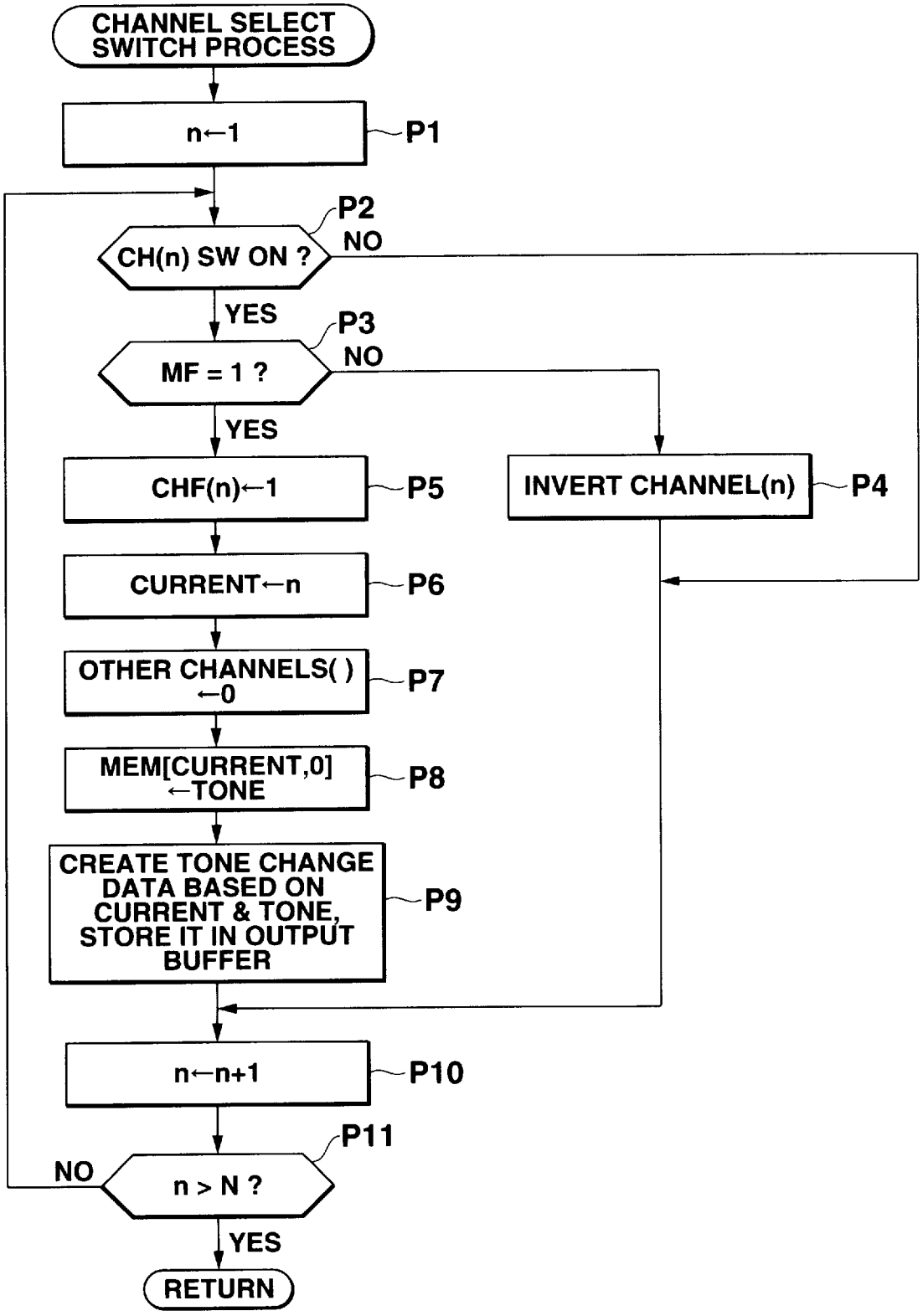
FIG. 18 is a flowchart of a channel select switch process of the second embodiment.
Figure 19:
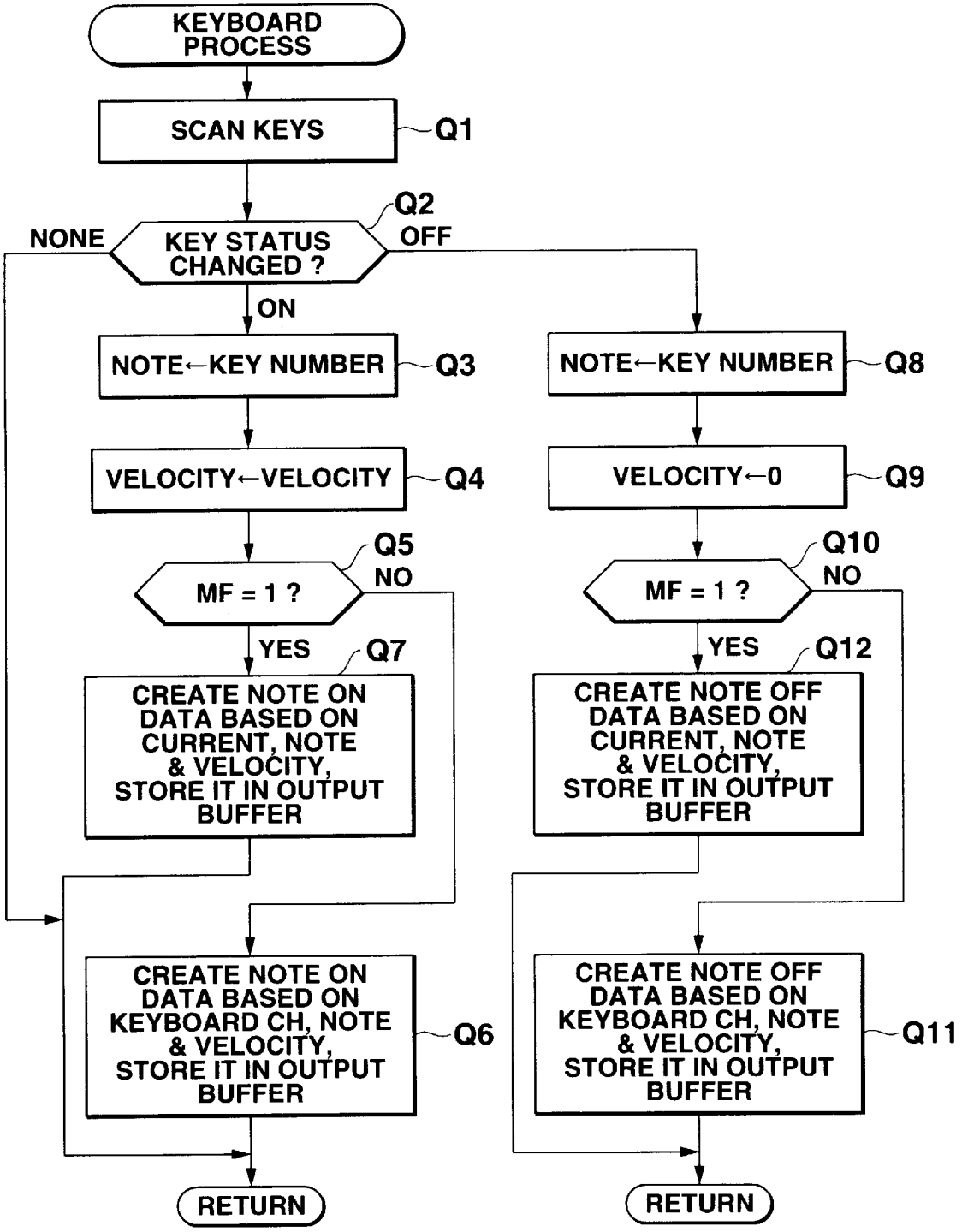
FIG. 19 is a flowchart of a keyboard process of the second embodiment.

A tone select switch process of FIG. 17, a channel select switch process of FIG. 18 and a keyboard process of FIG. 19 in the second embodiment are different from the corresponding ones of the first embodiment. FIG. 20 illustrates a transition of data in predetermined areas of the RAM in the second embodiment.

In the tone select switch process of FIG. 17, it is determined whether the tone switch is turned on (step N1). If otherwise, this process is terminated. If it is, the tone data (tone number) is stored in the register TONE (step N2). It is then determined whether the MF is 1 (step N3). If the MF is 0 (general performance mode), the sound source creates tone change data based on tone data in the TONE and data in the channel (0) specified for generation of a musical sound by the keyboard, and stores it in the output buffer (step N4).

For example, as shown in FIG. 20A, when a tone select switch "organ" is turned on in a state where (1) the MF is 0, (2) tone data in the TONE is "piano", and (3) tone data in the MEMs (1)–(3) are "guitar", "flute" and "sax", respectively, the tone data in the TONE is changed from "piano" to "organ", as shown in FIG. 20B. In this case, the tone data in the MEMs (1)–(3) are not changed. After the processing in step N4, this process is terminated.

When the MF is 1 (pattern create mode), tone change data is created based on channel data in the CURRENT and tone data in the TONE, and stored in the output buffer (step N5) The tone data in the TONE is stored in the MEM (CURRENT, 0) area corresponding to the specified current channel (step N6).

For example as shown in FIG. 20C, when a tone select switch "organ" is turned on in a state where (1) the MF is 1, (2) tone data in the TONE is "piano", (3) the current channel is 1, and (4) tone data in the MEMs (1)–(3) are "guitar", "flute" and "sax", respectively, the tone data in the TONE is changed from "piano" to "organ", and tone data in the MEM (1) corresponding to the current channel is changed from "guitar" to "organ". After the processing in step N6, this process is terminated.

FIG. 18 shows the channel select switch press. In this process, the pointer n which specifies a channel is set to 1 (step P1), and n is incremented sequentially while the following looping process is repeated.

That is, it is determined whether a channel (n) switch is turned on (step P2). If it is, it is then determined whether the MF is 1 (step P3). If the MF is 0, the channel flag CHF (n) is inverted (step P4). When the CHF (n) is inverted to 1, the channel (n) becomes a musical sound generate channel. When the CHF (n) is inverted to 0, the channel (n) becomes a mute channel.

When the MF is 1 in step P3, the CHF (n) is set to 1 (step P5) and the register CURRENT which indicates a current channel is set to n (step P6). CHFs other than the CHF (n) are set to 0 (step P7).

Data in the MEM (CURRENT, 0) corresponding to the current channel is then stored in the TONE (step P8). Then, the sound source creates tone change data based on tone data in the TONE and data in the channel (n) specified for generation of a musical sound by the current channel for accompaniment data and stores it in the output buffer (step P9). Then or when the channel (n) switch is not turned on in step P2 or when the CHF (n) is inverted in step P4, n is incremented (step P10). It is then determined whether n has exceeded the maximum value N (step P11). If otherwise, the control passes to step P2, where required ones of the above steps P2–P11 are repeated. When n has exceeded N, this process is terminated.

When, for example, as shown in FIG. 20D, a channel select switch "2" is turned on in a state where (1) the MF is 1, (2) tone data in the TONE is "organ", and (3) tone data in the MEMs (1)–(3) are "organ", "flute" and "sax", respectively, the tone data in the TONE is changed from "organ" to "flute" as shown in FIG. 20E. In this case, when a performance is given on the keyboard, a corresponding melody is generated in the "flute" tone from the channel (2). Further, when a channel select switch "3" is turned on in the state of FIG. 20E, the tone data in the TONE is changed from "flute" to "sax", as shown in FIG. 20F. In this case, when the keyboard performance generates a musical sound in a "sax" tone from the channel (3).

FIG. 19 is a flowchart of the keyboard process. First, the keys are scanned (step Q1) and it is determined whether there is a change in the key status (step Q2). If otherwise, this process is terminated. If there is or if a key is depressed, its key number or pitch data is stored in the register NOTE (step Q3), and velocity data is stored in the rester VELOCITY (step Q4). It is then determined whether the MF is "1" (step Q5).

When the MF is 0 (general performance mode), note-on data is created based on data in the channel (0) for generation of a musical sound by the keyboard, pitch data in the NOTE, and data in the VELOCITY, and then stored in the output buffer (step Q6). When the MF is 1 (pattern create mode), note-on data is created based on data in the current channel for pattern creation, pitch data in the NOTE, and velocity data in the VELOCITY, and stored in the output buffer (step Q7).

When there is a change in the key status which includes a release of a key in step Q2, its key number or pitch data is stored in the register NOTE (step Q8), and 0 is stored in the register VELOCITY (step Q9). It is then determined whether the MF is 1 (step Q10).

When the MF is 0, note-off data is created based on data in the channel (0) for generation of a musical sound by the keyboard, pitch data in the NOTE, and data "0" in the VELOCITY, and then stored in the output buffer (step Q11). When the MF is 1, note-off data is created based on data in the current channel for pattern creation, pitch data in the NOTE and velocity data "0" in the VELOCITY, and then stored in the output buffer (step Q12).

After the note-on data was created in step Q6 or Q7 and stored in the output buffer or after the note-off data was created in step Q11 or Q12 and stored in the output buffer, this process is terminated and the control returns to the main flow.

As described above, according to the second embodiment, when the tone is changed by the tone select switch, and the normal performance mode is selected, generation of a musical sound is controlled based on the changed tone data in the channel specified for generation of the musical sound by the keyboard. When the pattern create mode is selected, generation of the musical sound is controlled based on the changed tone data in the specified channel, and the tone data in the RAM storage area corresponding to the specified channel is set to the changed tone data.

Thus, in the pattern create mode, the channel specified for generation of the musical sound by the keyboard is separated from the keyboard and the channel specified for creation of a pattern operates in conjunction with the keyboard.

When the specified channel is changed in the pattern create mode, generation of the musical sound is controlled in the changed channel based on tone data in the storage area corresponding to the changed channel. Thus, when the channel for creating the pattern is changed, a pattern is created automatically with the tone data in the RAM storage area corresponding to the changed channel.

While in the above respective embodiments the arrangement in which the controller 1 executes the musical sound editing program in the memory has been described, a personal computer may be used to drive a recording medium such as a floppy disk or a compact disk on which a musical sound performance program to execute the program has been recorded to thereby edit a musical sound.

To this end, the musical sound editing program to be recorded in a recording medium is arranged to execute the steps of selecting either one of the general performance mode and the pattern create mode for accompaniment data, specifying a channel for creating the accompaniment data from among a plurality of channels, and when the mode is changed from the general performance mode to the pattern create mode by the mode selection, controlling generation of a musical sound based on tone data in the specified channel.

What is claimed is:

1. A musical sound editing apparatus comprising:

pitch input means for inputting pitch data in response to an external operation;

first tone storage means for storing tone data to control generation of a musical sound;

a generation channel for controlling the generation of the musical sound based on the inputted pitch data and the tone data stored in said first tone storage means;

a plurality of accompaniment channels;

storage means having a plurality of storage areas each corresponding to one of said plurality of accompaniment channels, and each pre-storing a respective one of a plurality of tone data and accompaniment pattern data;

mode selecting means for selecting one of a generation performance mode for general performance of a melody and a pattern create mode for creating a pattern of accompaniment;

channel specifying means for specifying one of said plurality of accompaniment channels to be used for creating a pattern of accompaniment; and musical sound controlling mean, responsive to said channel specifying means specifying one of the accompaniment channels in the pattern create mode, for changing the tone data stored in said first tone storage means into the tone data stored in the one of the plurality of storage areas of said storage means corresponding to the one of the accompaniment channels specified by said channel specifying means.

2. The musical sound editing apparatus according to claim 1, further comprising:

second tone storage means for storing tone data set in the general performance mode; and wherein, in response to said mode selecting means selecting the general performance mode, said musical sound controlling means changes the tone data stored in said first tone storage means into the tone data stored in said second tone storage means.

3. The musical sound editing apparatus according to claim 1, further comprising:

tone changing means for changing the respective tone data; and wherein, in response to an operation of said tone changing means, said musical sound controlling means changes the tone data stored in said first tone storage means, and also in response to said mode selecting means selecting the pattern create mode, said musical sound controlling means changes the tone data in the one of the plurality of storage areas of said storage means corresponding to the one of the accompaniment channels specified by said channel specifying means.

4. A musical sound editing apparatus comprising:

pitch input means for inputting pitch data in response to an external operation;

first tone storage means for storing tone data to control generation of a musical sound;

a generation channel for controlling the generation of the musical sound based on the inputted pitch data and the tone data stored in said first tone storage means;

a plurality of accompaniment channels;

storage means having a plurality of storage areas each corresponding to one of said plurality of accompaniment channels, and each pre-storing a respective one of a plurality of tone data and accompaniment pattern data;

mode selecting means for selecting one of a generation performance mode for general performance of a melody and a pattern create mode for creating a pattern of accompaniment;

channel specifying means for specifying one of said plurality of accompaniment channels to be used for creating a pattern of accompaniment; and musical sound controlling means, responsive to said channel specifying means specifying one of the accompaniment channels in the pattern create mode, for changing the tone data in the one of the plurality of storage areas of said storage means corresponding to the one of the accompaniment channels specified by said channel specifying means into the tone data stored in said first tone storage means; and storage controlling means for storing the pitch data inputted by said pitch inputting means as the pattern of accompaniment, into the one of the plurality of storage areas of said storage means corresponding to the one of the accompaniment channels specified by said channel specifying means.

5. The musical sound editing apparatus according to claim 4, further comprising:

tone changing means for changing the respective tone data; and wherein, in response to an operation of said tone changing means, said musical sound controlling means changes the tone data stored in said first tone storage means, and also in response to said mode selecting means selecting the pattern create mode, said musical sound controlling means changes the tone data in the one of the plurality of storage areas of said storage means corresponding to the one of the accompaniment channels specified by said channel specifying means.

6. A recording medium, readable by a computer, having stored thereon a musical sound editing program comprising:

generation channel program code means for controlling generation of a musical sound based on pitch data input by pitch inputting means and tone data stored in a first tone storage means; and musical sound control program code means, responsive to a channel specifying means specifying one accompaniment channel from among a plurality of accompaniment channels and also responsive to a mode selecting means selecting a pattern create mode, for changing the tone data stored in said first tone storage means into tone data stored in a storage area of a storage means corresponding to the one of the accompaniment channels specified by said channel specifying means.

7. A recording medium, readable by a computer, having stored thereon a musical sound editing program comprising:

generation channel program code means for controlling generation of a musical sound based on pitch data input by pitch inputting means and tone data stored in a first tone storage means; and musical sound control program code means, responsive to a channel specifying means specifying one accompaniment channel from among a plurality of accompaniment channels and also responsive to a mode selecting means selecting a pattern create mode, for changing tone data in a storage area of a storage means corresponding to the one of the accompaniment channels specified by said channel specifying means into the tone data stored in said first tone storage means; and storage control code means for storing the pitch data inputted by said pitch inputting means as the pattern of accompaniment, into the one of the plurality of storage areas of said storage means corresponding to the one of the accompaniment channels specified by said channel specifying means.

* * * * *